US006616428B2

(12) United States Patent
Ebara et al.

(10) Patent No.: US 6,616,428 B2
(45) Date of Patent: Sep. 9, 2003

(54) DOUBLE-CYLINDER TWO-STAGE COMPRESSION ROTARY COMPRESSOR

(75) Inventors: Toshiyuki Ebara, Ota (JP); Masaya Tadano, Nitta-machi (JP); Takashi Yamakawa, Oizumi-machi (JP); Atsushi Oda, Oizumi-machi (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/959,824

(22) PCT Filed: Mar. 15, 2001

(86) PCT No.: PCT/JP01/02074

§ 371 (c)(1),
(2), (4) Date: Nov. 8, 2001

(87) PCT Pub. No.: WO01/69087

PCT Pub. Date: Sep. 20, 2001

(65) Prior Publication Data

US 2002/0159904 A1 Oct. 31, 2002

(30) Foreign Application Priority Data

Mar. 15, 2000 (JP) ..... 2000-071479

(51) Int. Cl.[7] ..... F04C 23/00
(52) U.S. Cl. ..... 418/11; 418/60
(58) Field of Search ..... 418/11, 12, 60

(56) References Cited

U.S. PATENT DOCUMENTS 4,990,073 A * 2/1991 Kudo et al. ..... 418/60

FOREIGN PATENT DOCUMENTS

| | | | | |
|---|---|---|---|---|
| JP | 63-138189 | * 6/1988 | ..... | 418/11 |
| JP | 1-14787 | 4/1989 | | |
| JP | 2-294586 | * 12/1990 | ..... | 418/11 |
| JP | 3-225096 | * 10/1991 | ..... | 418/60 |
| JP | 4-153594 | * 5/1992 | ..... | 418/11 |
| JP | 11-118272 | 4/1999 | | |
| JP | 2000-54975 | 2/2000 | | |

OTHER PUBLICATIONS

Copy of International Search Report for corresponding PCT Application No. PCT/JP01/02074 dated May 1, 2001.

* cited by examiner

*Primary Examiner*—John J. Vrablik
(74) *Attorney, Agent, or Firm*—Armstrong, Westerman & Hattori, LLP

(57) ABSTRACT

A double-cylinder two-stage compression rotary compressor (10) comprising a first and a second compressors (32 , 34), driven by an electric motor (14), all accommodated in a sealed container (12). The first and the second compressor (32, 34) have respective first and second cylinders (40, 42) accommodating first and second rollers (48, 50), fitted on respective first and second eccentric cams (44, 46). The inner spaces of the first and second cylinders are partitioned by respective first and second vanes (52, 54) to form suction spaces and compression spaces. The two cylinders are separated by an intermediate partition panel (38), which has a central bore (36) for passing therethrough a shaft (16) of the motor (14). The center of the bore **(36*a*) of the intermediate partition panel (38) facing the first roller (48) is offset away from the center-of the shaft (16) to an angular position having a central angle about the center of the shaft in the range of 90±45 degrees with reference to the first vane (52), and the center of the bore (36*b*) of the intermediate partition panel (38) facing the second roller (50) is offset about the center of the shaft (16)** by an angle in the range of 270–360 degrees to increase the sealing areas of the rollers with the intermediate partition panel, thereby decreasing the leakage of the refrigerant gas and increasing volumetric efficiency and pressure efficiency of the compressor.

6 Claims, 5 Drawing Sheets

DOUBLE-CYLINDER TWO-STAGE COMPRESSION ROTARY COMPRESSOR

FIELD OF THE INVENTION

The invention relates to a double-cylinder two-stage compression rotary compressor, and more particularly to a double-cylinder two-stage compression rotary compressor which can adequately prevent leakage of refrigerant gas from the sealing of two compressors separated by an intermediate partition panel.

BACKGROUND OF THE INVENTION

Generally, a double-cylinder two-stage compression rotary compressor is accommodated in an enclosed container together with an electric motor connected with the rotary compressor by a common rotary shaft.

The rotary compressor comprises first and second cylinders for compressing a refrigerant gas, in two stages, to a first (intermediate) pressure by the first compressor and to a second (higher) pressure by the second compressor. The first and the second cylinders are separated by an intermediate partition panel. Associated with the first and the second cylinders, there are two eccentric members one for each cylinder, which are mounted on the rotary shaft and offset from each other in phase by 180°. Mounted on the respective eccentric members are annular rollers which are adapted to roll on the inner walls of the respective cylinders. The intermediate partition panel has a bore whose diameter is a little larger than the rotational diameter of the eccentric members or the inner diameter of the rollers.

As the rotary shaft rotates, the first roller rotates eccentrically in the first cylinder to take the refrigerant gas thereinto, compress it to an intermediate pressure, and discharges it. The elements participating in this compression constitute a first (stage) compressor. The compressed gas pressurized to this intermediate pressure is further pressurized by the eccentric rotation of the second roller in the second cylinder. These elements participating in the second compression constitutes a second (stage) compressor.

In a double-cylinder two stage compression rotary compressor where the pressures inside the rollers of the respective cylinders and in the bore of the intermediate partition panel are allowed to equilibrate with the pressure in the sealed container of the compressor, leakage of the refrigerant gas takes place between the insides of the rollers and the compression spaces (or suction spaces) in the cylinders, which leakage depends on the pressure difference across the roller end clearance and the width of the sealing areas between the rollers and the intermediate partition panel.

In a typical compressor, the bore of the intermediate partition panel is coaxial with the rotary shaft, for which the minimum roller end clearance is defined by a formula below.

Minimum roller end clearance (width)=[(outer diameter of a roller)+(eccentricity×2)−(shaft diameter+eccentricity×2+α)]/2where shaft diameter+eccentricity×2=shaft pin diameter.

In assembling the shaft, the bore of the intermediate partition panel must have an allowance a for allowing smooth passage of the shaft.

Since minimum roller end clearances,always exist on the opposite ends of each eccentric member, such prior art compressor suffers from the leakage of the refrigerant gas through the clearances, i.e. through spaces on the opposite ends of the eccentric members, due to the pressure difference between them, thereby degrading the volumetric efficiency and the compression efficiency of the compressor.

It is therefore a primary object of the invention to overcome above mentioned prior art problems by providing a double-cylinder two-stage compression rotary compressor equipped with an intermediate partition panel having a bore suitably configured to minimize the leakage of the refrigerant gas from the compressors, thereby attaining an improved volumetric efficiency and a compression efficiency and hence a large refrigeration performance, irrespective of whether the sealed container is designed to receive a higher, low, or an intermediate pressure gas.

SUMMARY OF THE INVENTION

In one aspect of the invention, there is provided a double-cylinder two-stage compression rotary compressor comprising:

- a sealed container;
- an electric motor accommodated in the sealed container;
- first and second eccentric cams mounted on the shaft of the motor;
- first and second rollers rotatably fitted on the respective first and second eccentric cams;
- first and second cylinders in which the first and second rollers are rolled on the respective inner walls of the cylinders when driven by the shaft;
- an intermediate partition panel having a central bore and separating the first and second cylinders;
- first and second support members sandwiching the first and second cylinders to form first and second spaces each defined by the intermediate partition panel, the respective roller and cylinder;
- first and second vanes, the first vane partitioning the first space into a first suction space and a first discharge space, and the second vane partitioning the second space into a second suction space and a second discharge space;
- first and second suction ports for taking a refrigeration gas into the suction spaces;
- first and second discharge ports for discharging compressed refrigerant gas out of the discharge spaces, wherein
  - together with the intermediate partition panel and first support member, the first eccentric member, first roller, and first cylinder constitutes a first compressor driven by the shaft for compressing to an intermediate pressure in the first discharge space the refrigerant gas taken in the first suction space via the first suction port and for discharging the compressed refrigerant gas from the first discharge port;
  - together with the intermediate partition panel and second support member, the second eccentric member, second roller, and second cylinder constitutes a second compressor driven by the shaft for compressing to a high pressure in the second discharge space the refrigerant gas taken from first discharge port into the second suction space via the second suction port and for discharging the compressed refrigerant gas from the second discharge port, the rotary compressor characterized in that:
    - the refrigerant gas having the intermediate pressure is discharged into the container, allowing the container to have the intermediate pressure,
    - the center of the bore of the intermediate partition panel facing the first compressor is offset away from the center of the shaft to an angular position having a central angle about the center of the shaft in the range of 270–360 degrees with reference to the vane (0 degree); and the center of the bore of the intermediate partition panel facing the second compressor is offset away from the center of the shaft to an angular position having a central angle about the center of the shaft in the range of 90±45 degrees with reference to the vane (0 degree).

By increasing the sealing area of each roller in sliding contact with the intermediate partition panel, across which a pressure difference is generated, sealability of the area can be improved.

The bore of the intermediate partition panel may be a two-step bore having first and second bores offset to each other.

The intermediate partition panel may be formed of a first partition panel facing the first compressor and having a first bore, and a second partition panel facing the second compressor and having a second bore.

The entire partition panel may be fabricated from a single plate by forming an inclined bore.

In a case where the high pressure refrigerant gas is released from the compressor into the sealed container, making the pressure high therein, the center of the bore of the intermediate partition panel is preferably offset away from the center of the shaft to an angular position having a central angle about the center of the shaft in the range of 270–360 degrees with reference to the vane (0 degree).

If, on the other hand, a low pressure refrigerant gas is released from the compressor into the sealed container, making the pressure low therein, the center of the bore of the intermediate partition panel is preferably offset away from the center of the shaft to an angular position having a central angle about the center of the shaft in the range of 90±45 degrees with reference to the vane (0 degree).

BRIEF DESCRIPTION OF THE DRAWINGS

These and other aspects of the present invention will be apparent from the following specific description, given by way of example, with reference to the accompanying drawings, in which.

BEST MODE FOR CARRYING OUT THE INVENTION

Figure 1:
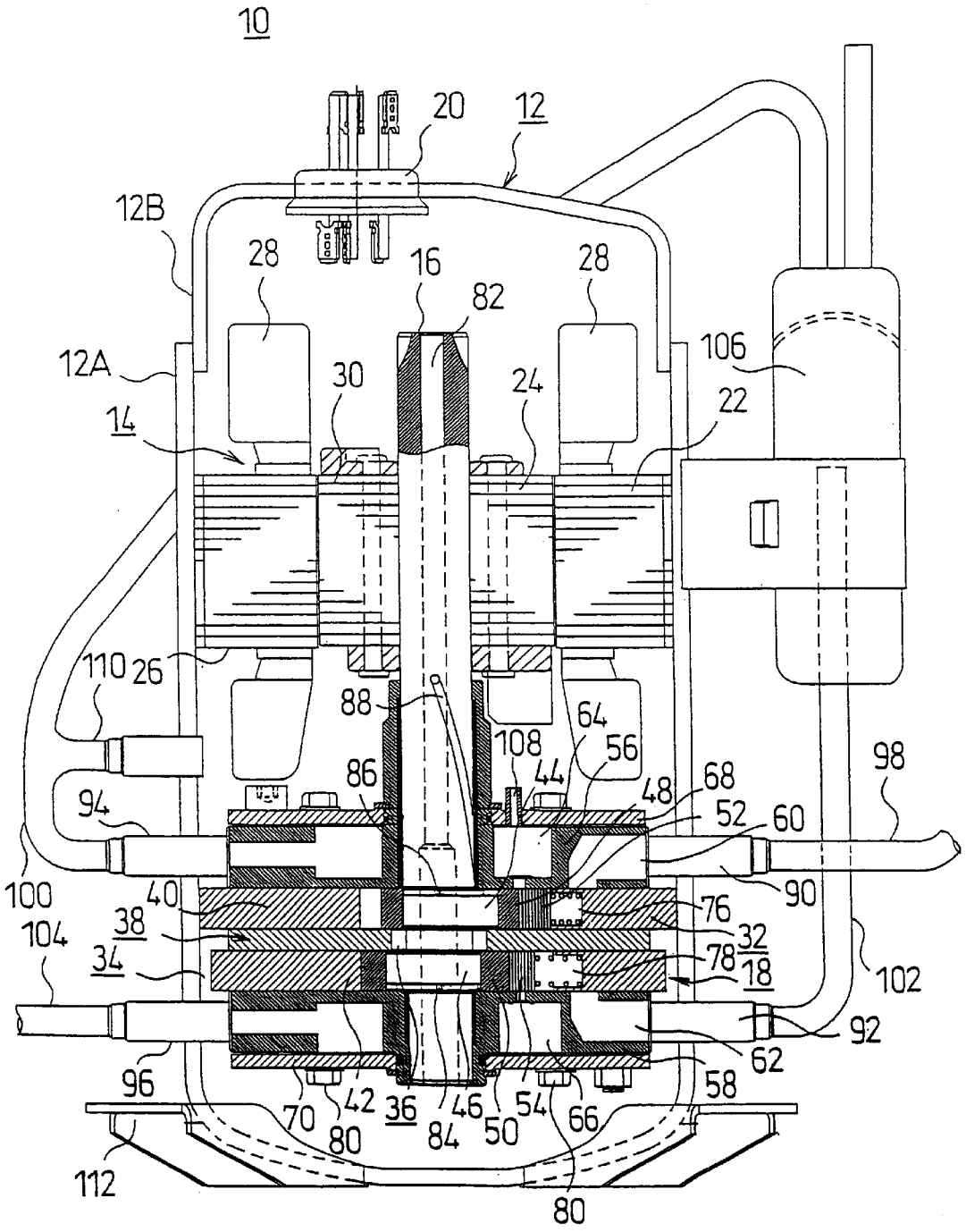
FIG. 1 shows a longitudinal cross section of an embodiment of an intermediate pressure type double-cylinder two-stage compression rotary compressor according to the invention.

FIG. 1 shows an embodiment of an intermediate pressure type double-cylinder two-stage compression rotary compressor 10 according to the invention for compressing a refrigerant gas. The compressor 10 comprises an electric motor 14 mounted in the upper section of a sealed cylindrical container 12; and a rotary compressor 18 mounted in the lower section of the container 12. The compressor 18 and the motor 14 have a common rotary shaft 16 so that the compressor 18 is driven by the electric motor 14.

The sealed container 12 has an oil sump at the bottom of the body 12A thereof for storing a lubricant. The electric motor 14 and the rotary compressor 18 are housed in the container body 12A. The container also has a cover 12B for closing the opening of the body 12A. Provided on the cover 12B are terminals 20 for receiving electric power for the electric motor 14 from an external power source (Lead wires are not shown.).

The base of the terminals 20 shown in FIG. 1 has a flat configuration. However, when the sealed container 12 is intended to receive a high (or intermediate) pressure, the base is preferable to have a protruding convex configuration in order to increase its strength against the pressure.

The electric motor 14 consists of a stator 22 mounted on the upper inner wall of the sealed container 12 and a rotor 24 located inside the stator 22 with a little clearance between them. The stator 22 includes a stack of magnetically susceptible annular steel layers 26 and coils 28 wound on the stacked steel layers 26. Like the stator 22, the rotor 24 also includes stacked layers 30 of magnetically susceptible steel plates and a rotary shaft 16 passing through the center of the stacked steel layers 30. The AC motor 14 may be substituted for by a DC motor having a rotor 24 in the form of permanent magnets.

Figure 2:
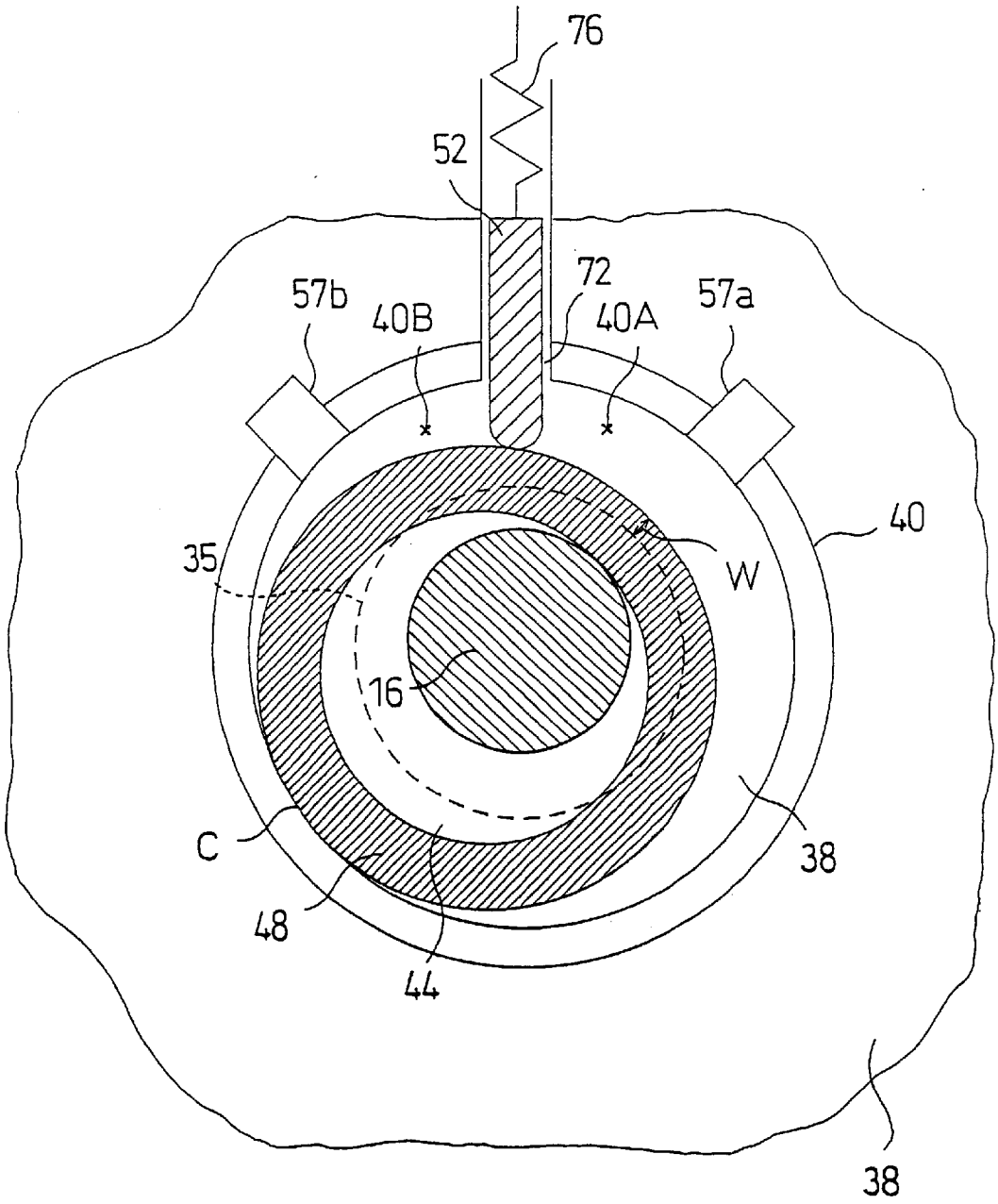
FIG. 2 shows a fragmentary cross section of the rotary compressor shown in FIG. 1, illustrating a main portion thereof.

FIG. 2 is a schematic view of a first compressor 32 having a first cylinder 40. The same structure applies to a second compressor 34. Referring again to FIG. 1 along with FIG. 2, there is shown first and second eccentric cams 44 and 46, respectively, which are formed on, and integral with, an extended portion of the rotary shaft 16 of the electric motor 14. Rotatably mounted on the respective eccentric cams 44 and 46 are a first and a second roller 48 and 50, respectively, which are in rotational contact with the inner walls of the respective first and the second cylinders 40 and 42, following the rotational motion of the shaft 16. Provided between the first and the second cylinders 40 and 42 is an intermediate partition panel 38 separating the two cylinders 40 and 42. Thus, first and second support members 56 and 58, respectively, are provided to cover the upper end of the first cylinder 40 and the lower end of the cylinder 42 so that first and second spaces are formed within the respective cylinders 40 and 42 and outside the respective rollers 48 and 50, and between these support members 56 and 58 and the intermediate partition panel 38. The respective first and second spaces are partitioned by first and second vanes 52 and 54, respectively, which are slidably mounted in the respective radial guiding grooves 72 and 74 formed in the respective cylinder walls of the first and the second cylinders 40 and 42, respectively. The first and the second vanes are biased by respective springs 76 and 78 so as to abut on the respective rollers 48 and 50. In order to perform suction and discharge of the refrigerant gas into and out of the spaces partitioned by the vanes 52 and 54, there are provided, on the opposite sides of the respective vanes in the cylinders 40 and 42, first and second suction ports 57*a* and 59*a*, respectively, and first and second discharge ports 57*b* and 59*b*, respectively, thereby forming first and second suction spaces 40A and 42A, respectively, for taking the refrigerant gas thereinto, and first and second discharge spaces 40B and 42B, respectively, for compressing and discharging the refrigerant gas. The, discharge ports 57*b* and 59*b* are provided with valves which are each adapted to open when the pressures in the respective discharge spaces 40B and 42B have reached a predetermined level.

Thus, the rotary compressor 18 operatively connected with the electric motor 14 first compresses the low pressure refrigerant gas to an intermediate pressure in the first compressor 32 (referred to as intermediate pressure compressor) by taking the refrigerant gas into the suction space 40A via the first suction port 57*a*, pushing the gas into the compression and discharge space 40B by the rotation of the roller 48, and discharging the compressed gas from the first discharge port 57*b*.

The compressor 18 further compresses the gas to a high pressure in the second compressor (referred to as high pressure compressor) 34 by taking the compressed gas discharged from the first discharge port 57*b* into the suction space 42A, compressing it in the second discharge space 42B. The compressed gas is discharged from the discharge space 42B via the second discharge port 59*b*.

The first and the second support members 56 and 58, respectively, are provided with respective suction passages 60 and 62 which communicate with the respective suction spaces 40A and 42A of the first and the second cylinders 40 and 42, respectively, and with discharge silencer chambers 64 and 66 which are formed in the respective support members 56 and 58 to communicate with the respective discharge spaces 40B and 42B. The openings of the silencer chambers 64 and 66 are closed by a first and a second panel 68 and 70, respectively.

The intermediate partition panel 38 has a circularbore 36 having a diameter which is slightly larger than that of the eccentric cam 46 so as to print the rotary shaft 16 and the second eccentric cam 46 to pass through the bore 36. The bore 36 of the intermediate partition panel 38 and the inner space of the roller 44 communicate with the remaining space of the container 12 through a gap formed along the shaft 16 so that the pressures in those spaces are equilibrated with the pressure in the container 12.

The minimum width w of the sealing area between the intermediate partition panel 38 and the end faces of the first and the second rollers 48 and 50, respectively, will be uniform at all angles about the center of the shaft 16 if the bore 36 is positioned coaxial with the rotary shaft 16 as shown by a broken line in FIG. 2. However, the pressure difference, for example, across the inside and the outside of the first roller 48 is not uniform, which difference depends on the pressure in the container and the angular position of the rotary shaft 16.

The invention is aimed to overcome these drawbacks pertinent to the prior art by providing an intermediate partition panel 38 having a bore 36 which is offset in the direction away from the angular position where the pressure difference increases, so that the width w of the overlapping sealing area between the roller end face and the intermediate partition panel is increased at the offset position.

In the example shown herein, the intermediate partition panel 38 is fixed between the two cylinders 40 and 42 such that the center 36*ac* of the bore 36*a* facing the first cylinder 40 of the first compressor 32 is offset away from the center 16*c* of the center of the shaft 16 to an angular position having a central angle about the center of the shaft in the range from 270 to 360 degrees (315 degrees in the example shown in FIG. 3) with reference to the angular position of the first vane 52 (0 degree).

Figure 3:
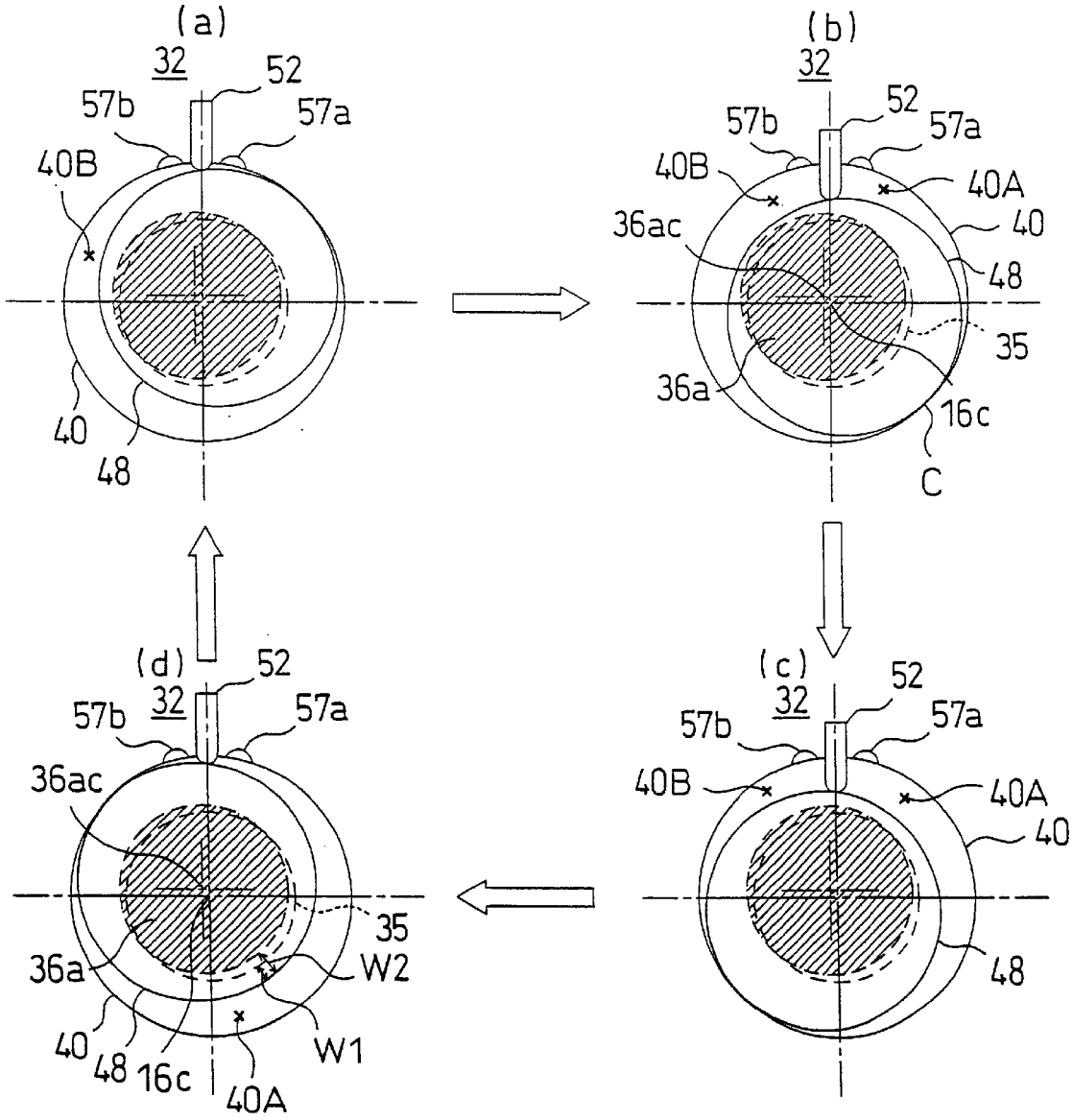
FIGS. 3(*a*)–(*d*) show in plan view the movement of the first compressor during its operation.

FIGS. 3(*a*)–(*b*) represent a suction process; FIGS. 3(*b*)–(*c*), a compression process; and FIGS. 3(*c*)–(*d*), a discharge process. In each of these figures, the outmost circle represents the first cylinder 40, having its center coinciding with the center 16*c* of the rotary shaft 16. The next largest circle indicates the first roller 48 in eccentric rotation. The innermost shaded circle represents the bore 36*a* of the intermediate partition panel 38 having its center 36*ac* offset away from the center 16*c* of the shaft 16 to an angular position having a central angle of 315 degrees about the center of the shaft with reference to the angular position of the first vane 52. In FIGS. 3(*a*)–(*d*), phantom circles 35 with broken line indicate the position occupied by the bore 36*a* of the intermediate partition panel 38 if the bore 36*a* were positioned coaxial with the shaft 16.

In the example shown herein, the refrigerant gas compressed in the first compressor 32 to the intermediate pressure is partly released to the container 12 en route to the second compressor 34. As a result, the pressure inside the first roller 48 becomes intermediate, creating the largest pressure difference between the inside of the roller 48 and the suction space 40A of the first cylinder 40. That is, under the condition shown in FIG. 3(*d*), the pressure in the suction space 40A outside the roller 48 and inside the first cylinder 40 is low but the pressure inside the first roller 48 becomes intermediate, creating the largest pressure difference across the roller 48 and promoting the leakage of the refrigerant gas from the inside of the first roller 48 to the suction space 40A. It is noted that the width of the sealing area is increased from w1 to w2 by offsetting the bore 36*a* of the intermediate partition panel 38 in the direction as described above.

Figure 4:
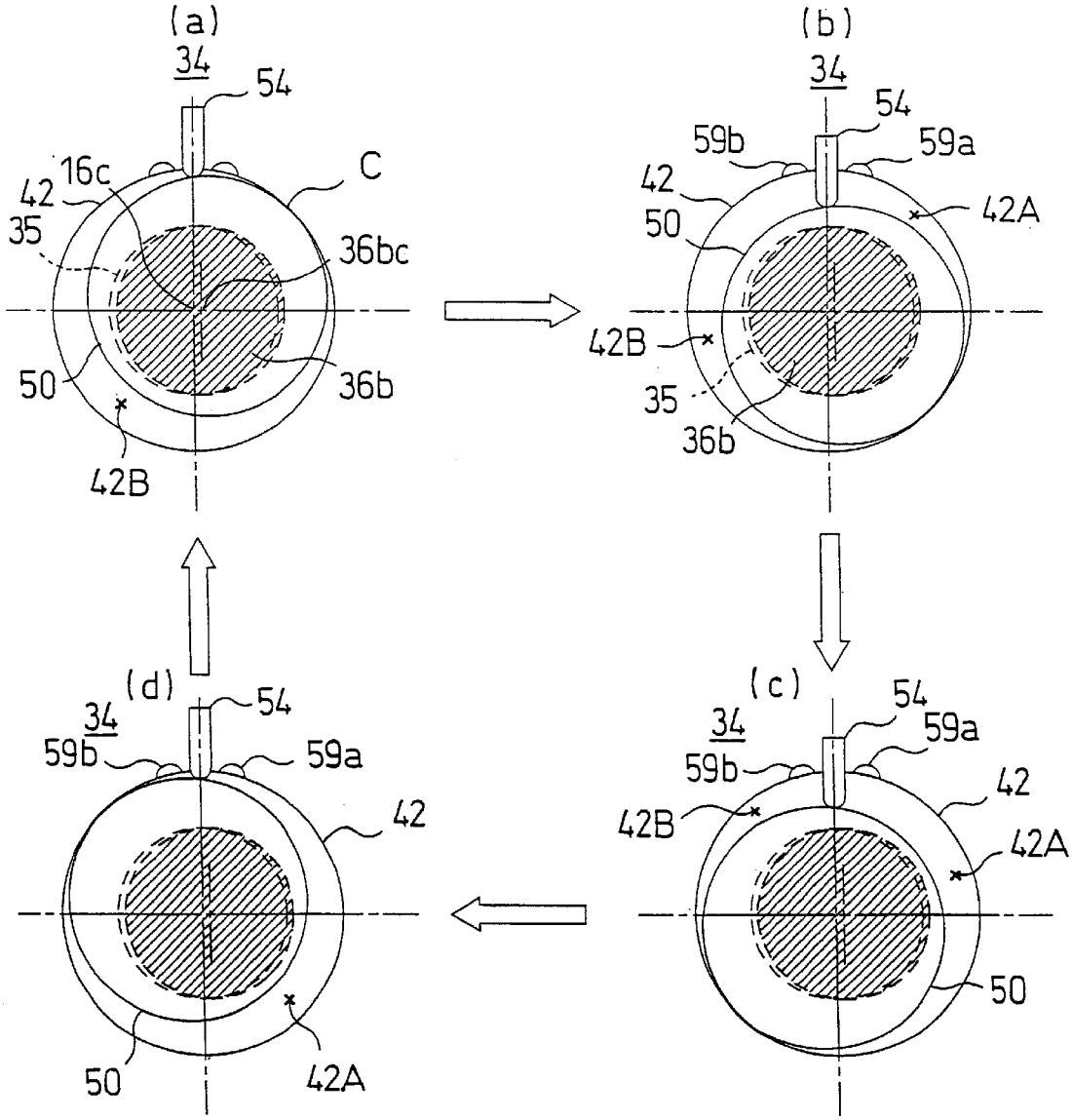
FIGS. 4(*a*)–(*d*) show in plan view the movement of the second compressor during its operation FIGS. 5(*a*)–(*c*) are fragmentary cross sections of different embodiments of the inventive intermediate partition panel, showing details of major sections of the embodiments.

On the other hand, as seen in FIG. 4, the pressure in the suction space 42A in the second compressor 34 is at the same intermediate level as the internal pressure inside the second roller 50, so that a pressure difference is created between the second compression space 42B and the inside of the second roller 50. In order to prevent the leakage of the refrigerant gas due to this pressure difference from occurring, the intermediate partition panel 38 is positioned so that the center of the bore 36*b* of the intermediate partition panel 38 facing the second cylinder 42 is offset away from the center of the shaft 16 to an angular position having a central angle about the center of the shaft in the range of 90±45 degrees with reference to the angular position of the second vane 54 (0 degree).

FIGS. 4(*a*)–(*b*) represent a suction process; FIGS. 4(*b*)–(*c*), a compression process; and FIGS. 4(*c*)–(*d*), a discharge process. In each of these figures, the outmost circle represents the second cylinder 42, having its center positioned at the center 16*c* of the rotary shaft 16. The next largest circle represents the second roller 50 in eccentric rotation. The inner most shaded circle indicates the bore 36*b* of the intermediate partition panel 38 having its center offset away from the center of the shaft 16 to an angular position having a central angle of 90 degrees about the center of the shaft with reference to the angular position of the second vane 54. In FIG. 4, phantom circles 35 with broken line indicate the imaginary position occupied by the bore 36*b* facing the second compressor 34 if the bore 36*b* were positioned coaxial with the shaft 16.

As described previously, the pressure difference in the second compressor 34 mainly takes place between the discharge space 42B and the inside of the second roller 50. On the other hand, the rotational angle (referred to as starting angle) of the roller 50 at which the roller 50 starts discharging the refrigerant gas from the discharge space B via the discharge port 59*b* depends on the pressure of the compressed gas in the discharge space B. Further, the pressure of the compressed gas also depends on the balance of pressures among different components such as a condenser, expansion valves, and an evaporator in the external refrigeration circuit. Thus, the starting angle of the roller 50 (i.e. the angular position of the contact point C of the roller 50 on the inner wall of the cylinder 42) can vary widely. In extreme cases the angle can vary from about 0 degree to about 360 degrees with reference to the vane 54 (0 degrees). Thus, in the example shown in FIG. 4, the center of the bore 36*b* of the intermediate partition panel 38 facing the second cylinder 42 is offset such that the minimum width w of the sealing area takes place in the rotational angle within 180–360 degrees (which range belongs to the compression space B), as described in connection with FIG. 2. In other words, the center of the bore 36*b* is offset away from the center of the shaft 16 to an angular position having a central angle of 90 degrees about the center of the shaft with reference to the angular position of the second vane 54 (0 degree). This offset provides an optimum seal width over a wide range of rotational angle of the roller 50.

Figure 5:
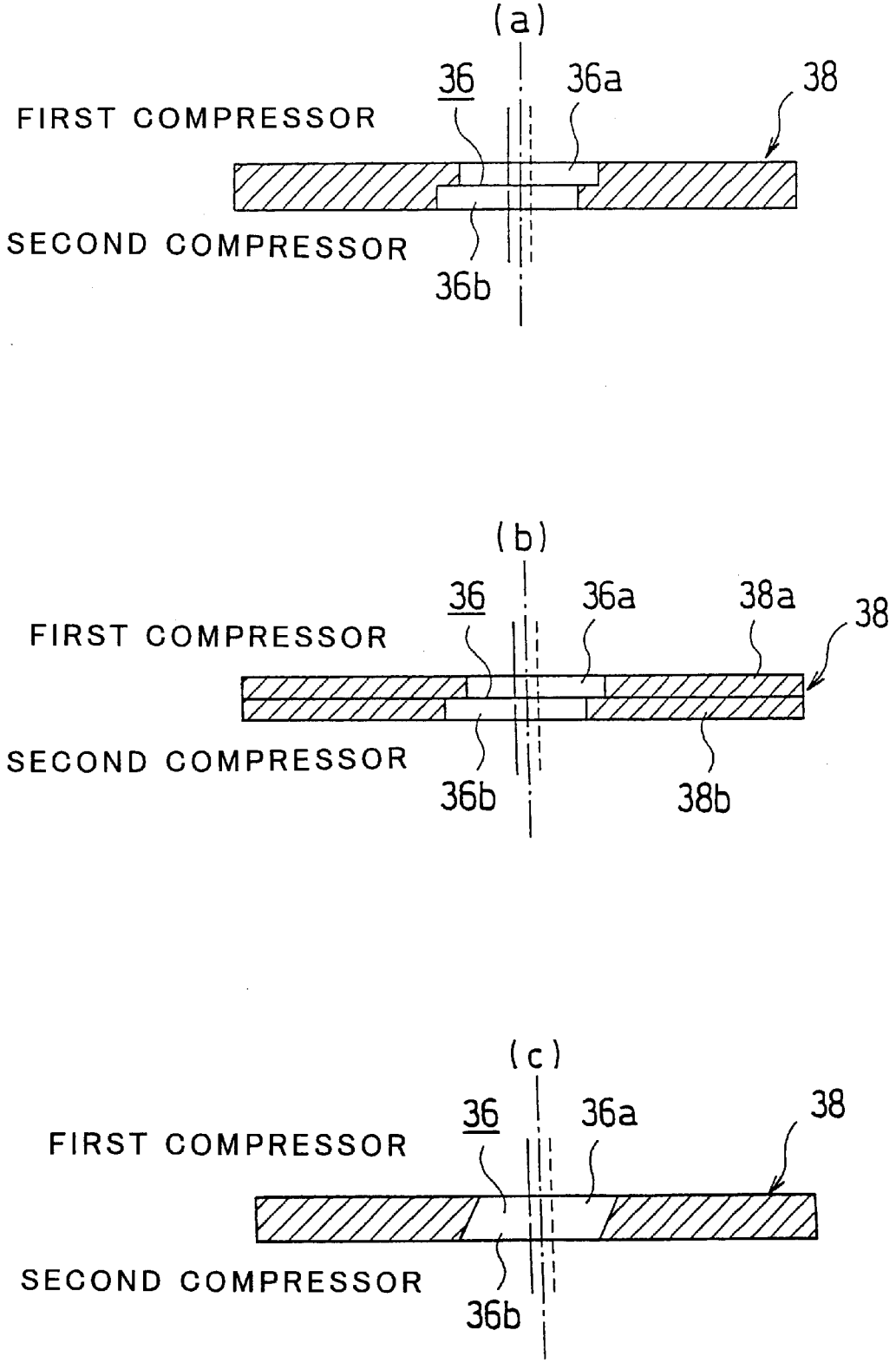

FIG. 5 shows the cross section of the intermediate partition panel 38 constructed in accord with the embodiment described above. The intermediate partition panel 38 has a two-step bore 36 as shown in FIG. 5(*a*), which bore, however, cannot permit the second eccentric cam 46 to pass through it if fabricated in a single panel. Hence, in actuality, the intermediate partition panel 38 is formed of two panels 38*a* and 38*b* having mutually offset bores and stacked together as shown in FIG. 5(*b*).

It is noted, however, that if the bore 36 is inclined such that the portion 36*a* of the bore 36 facing the first cylinder and the portion 36*b* of the bore 36 facing the second cylinder are offset away from the center of the rotary shaft 16 as described above and shown in FIG. 5(*c*), the second eccentric cam 46 can pass through it. This intermediate partition panel 38 can be made of a single panel.

The rotary compressor 18 as described above may be assembled by stacking the first support member 56, first cylinder 40, intermediate partition panel 38, second cylinder 42, and second support member 58 in the order mentioned between the first and the second panels 68 and 70, respectively, and securely coupling them together by a multiplicity of mounting bolts 80.

The shaft 16 is provided with a vertical straight oil hole 82 running through it and with transverse oiling inlets 84 and 86 crossing the oil hole 82, and with a spiral oiling groove 88 on the exterior of the shaft. Through these oil passages oil is supplied to the bearings of the first and the second support member 56 and 58, respectively, and to other slidable parts of the compressor.

Connected with the respective suction passages 60 and 62 of the first and the second support members 56 and 58, respectively, are first and second refrigerant introduction tubes 90 and 92, respectively, for introducing the refrigerant to the first and the second cylinders 40 and 42, respectively. First and second refrigerant discharge tubes 94 and 96, respectively, for discharging the refrigerant gas compressed in the first and second cylinders 40 and 42 are connected with the respective discharge silencer chambers 64 and 66.

In addition, the first and the second refrigerant introduction tubes 90 and 92, respectively, and the first and second refrigerant discharge tubes 94 and 96, respectively, are connected with respective refrigerant tubes 98, 100, 102, and 104. An accumulator 106 is connected between the refrigerant tubes 100 and 102.

Moreover, the first panel 68 is connected with a discharge tube 108 which communicates with the discharge silencer chamber 64 formed in the first support member 56 to partly discharge the intermediate pressure refrigerant gas into the sealed container 12 directly. At a bifurcation tube 110, the gas released into the sealed container 12 merges with the refrigerant gas discharged from the first discharge tube 94 via the discharge silencer chamber 64.

The cylindrical container 12 has a mount base 112 which is soldered to the bottom of the container 12 for securely fixing the container 12.

It is noted that in the example shown herein carbon dioxide($CO_2$) is used as a non-flammable and non-toxic natural refrigerant recommended from an ecological point of view. It is presumed that a conventional oil such as mineral oil, alkyl-benzene oil, and ester-oil, is used as a lubricant.

Operation of the double-cylinder two-stage compression rotary compressor will now be briefly described.

First, electric power is supplied to the coil 28 of the electric motor 14 via the terminals 20 and lead wires(not shown) to energize the rotor 24 to rotate the shaft 16. As a result, the first and the second rollers 48 and 50, respectively, fitted on the first and the second eccentric cams 44 and 46, respectively, undergo eccentric rotations in the respective first and the second cylinders 40 and 42. Consequently, the refrigerant gas is taken in the suction space 40A of the first cylinder 40 from the suction port 57*a* via the refrigerant tube 98, first refrigerant introduction tube 90, and suction passage 60. The refrigerant gas taken in the suction space 40A is compressed (first stage compression) by the rolling action of the first roller 48 in collaboration with the first vane 52. The compressed refrigerant gas will have an intermediate pressure as it is discharged from the first discharge space 40B into the discharge silencer chamber 64 of the first support member 56 via the discharge port 57*b*. This gas is partly released once from the discharge tube 108 to the sealed container 12. The rest of the gas is discharged from the discharge silencer chamber 64 into the refrigerant tube 100 via the first refrigerant discharge tube 94, and merges with the refrigerant gas from the bifurcation tube 110 in the sealed container 12.

After the merging, the refrigerant gas of intermediate pressure is passed to the accumulator 106 and further to the second suction passage 62 through the refrigerant tube 102 and second refrigerant introduction tube 92, from where the gas is taken in the second suction space 42A of the second cylinder 42 via the suction port 59*a*. In the second cylinder 42, the refrigerant gas is further compressed by the second roller 50 in collaboration with the second vane 54 for compression to a high pressure (second stage compression). The gas is then discharged from the second discharge space 42B of the second cylinder 42 into the discharge silencer chamber 66 via the discharge port 59*b*. The discharged refrigerant gas of high pressure is passed through the second discharge tube 96 and the refrigerant tube 104 to a refrigeration circuit of an external refrigeration apparatus (not shown). The sequence of such suction, compression, and discharge processes is performed simultaneously and continuously in both of the first and the second compressors.

It is recalled that the first and second rollers 48 and 50, respectively, are fitted on the respective first and the second eccentric cams 44 and 46 which are integral with the rotary shaft 16, and undergo eccentric rotational motions inside the first and the second cylinders 40 and 42, respectively, and that the intermediate partition panel 38 placed between the first and the second cylinders 40 and 42, respectively, is provided with the bore 36 for receiving the rotary shaft 16. The bore 36 is formed such that the center of the bore 36*a* facing the first cylinder is offset away from the center of the shaft 16 to an angular position having a central angle of 315 degrees about the center of the shaft with respect to the first vane 52 (0 degree). As a result, the first roller 48 and the intermediate partition panel 38 have a greater sealing area (or contact area) between them at an angular position of the roller 48 where the pressure difference becomes largest between them, thereby minimizing leakage of the refrigerant gas. Similarly, the center of the bore 36*b* facing the second cylinder is offset away from the center of the shaft 16 to an angular position having a central angle of 90 degrees about the center of the shaft with reference to the second vane 54 (0 degree), so that the sealing area between the second roller 50 and the intermediate partition panel 38 is maximized at an angular position where the pressure difference between them becomes large, thereby minimizing leakage of the refrigerant gas during the compression process.

The lubricant oil (not shown) is raised by the rotational motion of the rotary shaft 16 from the oil sump at the bottom of the sealed container 12 through the vertical oil hole 82 formed along the axis of the rotary shaft 16, and flows out of the transverse oiling inlets 84 and 86 formed intermediate the oil hole 82. The oil is then supplied to the spiral oil groove 88. Consequently, desired lubrication is obtained for the shaft 16 in the bearings and for the rollers 48 and 50 on the respective eccentric cams 44 and 46, thereby providing smooth rotation of the shaft 16 and the eccentric cams 44 and 46.

In the above embodiment, the invention has been described for a particular example of a double-cylinder two-stage compression rotary compressor 10 where the refrigerant gas is compressed to an intermediate pressure in the first compressor 32, discharged therefrom into the sealed container 12, and further compressed to a higher pressure in the second compressor 34. It should be understood that in a case where the gas is compressed by the second compressor 34 to a high pressure and discharged in the sealed container 12, the pressure in the container 12 will be high, and so are the pressures inside the first and the second rollers 48 and 50. Then, large pressure differences are created mainly between the insides of the rollers 48 and 50, and the suction spaces 40A and 42A of the first and the second compressors. Thus, in this instance the center of the bore 36 of the intermediate partition panel 38 may be offset away from the center 16*c* of the shaft 16 (i.e. in the direction away from the suction spaces 40A and 42A) to an angular position having a central angle between 270 and 360 degrees about the center of the shaft with reference to the angular position of the respective vanes 52 and 54 (0 degree). As an example, the intermediate partition panel 38 may be fixed in position with its center offset to the angular position of 315 degrees, as in the previous example shown in FIG. 3.

In a case of a low-pressure type double-cylinder two-stage compression rotary compressor 10 where the sealed container 12 serves as a low pressure container, pressure differences are created mainly between the discharge spaces 40B and 42B and the insides of the respective rollers 48 and 50, so that the center of the bore 36 of the intermediate partition panel 38 may be offset in the direction away from the discharge spaces, i.e. offset away from the shaft 16, to an angular position having a central angle about the center of the shaft in the range of 90 degrees (as shown in FIG. 4)±45 degrees with reference to the angular positions of the vanes 52 and 54 (0 degree).

In this manner, as shown in the embodiments described above, sealing area between the eccentric rollers in the respective cylinders and the intermediate partition panel may be maximized by adequately offsetting the center of the bore of the intermediate partition panel away from the shaft to an angular position where the maximum pressure difference takes place, thereby minimizing leakage of the refrigerant gas and improving volumetric efficiency and compression efficiency of the compressor.

Industrial Utility

The invention can maximize the sealing area of the eccentric rollers in contact with the intermediate partition panel for their angular positions where the pressure difference becomes large, which improves volumetric efficiency and compression efficiency of the compressor.

We claim:

1. A double-cylinder two-stage compression rotary compressor comprising:

a sealed container;

an electric motor accommodated in said sealed container;

first and second eccentric cams mounted on a shaft of said motor;

first and second rollers rotatably fitted on the respective first and second eccentric cams;

first and second cylinders in which said first and second rollers are rolled on the respective inner walls of said cylinders when driven by said shaft;

an intermediate partition panel having a central bore and separating said first and second cylinders;

first and second support members sandwiching said first and second cylinders to form first and second spaces which are defined by said intermediate partition panel, exteriors of said first and second rollers, and said inner walls of said first and second cylinders;

first and second vanes, said first vane partitioning said first space into a first suction space and a first discharge space, and said second vane partitioning said second space into a second suction space and a second discharge space;

first and second suction ports for taking refrigeration gas into the respective suction spaces;

first and second discharge ports for discharging compressed refrigerant gas out of said respective discharge spaces, wherein together with said intermediate partition panel and first support member, said first eccentric member, first roller, first vane and first cylinder constitute a first compressor driven by said shaft for compressing to an intermediate pressure in said first discharge space the refrigerant gas taken in said first suction space via said first suction port and for discharging the compressed refrigerant gas from said first discharge port;

together with said intermediate partition panel and second support member, said second eccentric member, second roller second vane and second cylinder constituting a second compressor driven by said shaft for compressing to a high pressure in said second discharge space the refrigerant gas taken from first discharge port into said second suction space via said second suction port and for discharging the compressed refrigerant gas from said second discharge port, said rotary compressor characterized in that:

means for discharging said high pressure refrigerant gas into said sealed container, thereby allowing said container to have the high pressure; and the center of said bore of said intermediate partition panel is offset away from the center of the shaft to an angular position having a central angle about the center of the sbaft in the range of 270–360 degrees with reference to said first vane (0 degree).

2. A double-cylinder two-singe compression rotary compressor comprising:

a sealed container;

an electric motor accommodated in said sealed container;

first and second eccentric cams mounted on a shaft of said motor;

first and second rollers rotatably fitted on the respective first and second eccentric cams;

first and second cylinders in which said first and second rollers are rolled on the respective inner walls of said cylinders when driven by said shaft;

an intermediate partition panel having a central bore and separating said first and second cylinders;

first and second support members sandwiching said first and second cylinders to form first and second spaces which are defined by said intermediate partition panel, exteriors of said first and second rollers, and said inner walls of said first and second cylinders;

first and second vanes, said first vane partitioning said first space into a first suction space and a first discharge space, and said second vane partitioning said second space into a second suction space and a second discharge space;

first and second suction ports for taking refrigeration gas into the respective suction spaces;

first and second discharge ports for discharging compressed refrigerant gas out of said respective discharge spaces, wherein together with said intermediate partition panel and first support member, said first eccentric member, first roller first vane and first cylinder constituting a first compressor driven by said shaft for compressing to an intermediate pressure in said first discharge space the refrigerant gas taken in said first suction space via said first suction port and for discharging the compressed refrigerant gas from said first discharge port;

together with said intermediate partition panel and second support member, said second eccentric member, second roller, second vane and second cylinder constituting a second compressor driven by said shaft for compressing to a high pressure in said second discharge space the refrigerant gas taken from said first discharge port into said second suction space via said second suction port and for discharging the compressed refrigerant gas from said second discharge port, said rotary compressor characterized in that:

said sealed container having a refrigerant gas at low pressure and communicating with said first suction port; and the center of said bore of said intermediate partition panel is offset away from the center of the shaft to an angular position having a central angle about the center of the shaft in the range of 90±45 degrees with reference to said second vane (0 degree).

3. A double-cylinder two-stage compression rotary compressor comprising:

a seated container;

an electric motor accommodated in said scaled container;

first and second eccentric cams mounted on the shaft of said motor, first and second rollers rotatably fitted on first and second eccentric cams;

first and second cylinders in which said first and second rollers are rolled on the respective inner walls of said cylinders when driven by said shaft;

an intermediate partition panel having a central bore and separating said first and second cylinders;

first and second support members sandwiching said firs and second cylinders to form first and second spaces which are defined by said intermediate partition panel, exteriors of said first and second rollers, and said inner walls of said first and second cylinders;

first and second vanes, said first vane partitioning said first space into a first suction space and a first discharge space, and said second vane partitioning said second space into a second suction space and a second discharge space;

first and second suction ports for taking refrigeration gas into the respective suction spaces;

first and second discharge ports for discharging compressed refrigerant gas out of said respective discharge spaces, wherein together with said intermediate partition panel and first support member, said first eccentric member, first roller, first vane and first cylinder constitute a first compressor driven by said shaft for compressing to an intermediate pressure in said first discharge space the refrigerant gas taken in said first suction space via said first suction port and for discharging the compressed refrigerant gas from said first discharge port;

together with said intermediate partition panel and second support member, said second eccentric member, second roller, second vane and second cylinder constitute a second compressor driven by said shaft for compressing to a high pressure in said second discharge space the refrigerant gas taken from said first discharge port into said second suction space via said second suction port and for discharging the compressed refrigerant gas from said second discharge port, said rotary compressor characterized in that:

said intermediate pressure refrigerant gas is discharged into said container, allowing said container to have the intermediate pressure;

the center of said bore of said intermediate partition panel facing said first compressor is offset away from the center of the shaft to an angular position having a central angle about the center of the shaft in the range of 270–360 degrees with reference to said first vane (0 degree); and the center of said bore of said intermediate partition panel facing 'said second compressor is offset away from the center of the shaft to an angular position having a central angle about the center of the shaft in the range of 90±45 degrees with reference to said second vane. (0 degree).

4. The rotary compressor according to claim 3, wherein said bore of said intermediate partition panel is a two-step bore.

5. The rotary compressor according to claim 3, wherein said intermediate partition panel consists of a first partition panel having a first offset bore facing said first compressor, and a second partition panel having a second offset bore facing said second compressor.

6. The rotary compressor according to claim 3, wherein said intermediate partition panel has an inclined bore.

* * * * *